United States Patent [19]

Kohler et al.

[11] Patent Number: 4,644,763

[45] Date of Patent: Feb. 24, 1987

[54] KNITTING MACHINE WITH ELECTROMAGNETIC NEEDLE SELECTION

[75] Inventors: Fritz Kohler; Andre Perotti, both of Couvet, Switzerland

[73] Assignee: Edouard Dubied & Cie, S.A., Couvet, Switzerland

[21] Appl. No.: 883,528

[22] Filed: Jul. 9, 1986

[30] Foreign Application Priority Data

Jul. 12, 1985 [CH] Switzerland ..... 3027/85

[51] Int. Cl.[4] ..... D04B 7/00

[52] U.S. Cl. ..... 66/75.2

[58] Field of Search ..... 66/75.2

[56] References Cited

U.S. PATENT DOCUMENTS

| | | | |
|---|---|---|---|
| 3,717,014 | 2/1973 | Kohler | 66/75.2 |
| 4,041,732 | 8/1977 | Krause | 66/72.5 |
| 4,214,460 | 7/1980 | Shimy | 66/75.2 |
| 4,481,793 | 11/1984 | Cuche et al. | 66/75.2 |
| 4,490,994 | 1/1985 | Essig | 66/75.2 |
| 4,554,803 | 11/1985 | Schmodde et al. | 66/75.2 |

*Primary Examiner*—Ronald Feldbaum

*Attorney, Agent, or Firm*—Lewis H. Eslinger

[57] ABSTRACT

In a knitting machine, electromagnetically controlled selector stations cooperate with sliding devices to enable them to assume two different positions. The sliding devices act in pairs on each needle of the knitting machine, and fixed vertical cams act on so-called two-arm levers to release them after selection, with the two-arm levers being retained or not by the sliding devices. Provision is made so that the two-arm levers can be oriented in four different positions. Each pair of sliding devices is composed of a first lower selector and a juxtaposed second lower selector, each of which can be moved into two different positions so as to produce the different four positions of the two-arm levers, in this way the needles may be controlled individually into tucking, out-of-action, standard knitting, and lengthened stitch knitting positions.

8 Claims, 11 Drawing Figures

KNITTING MACHINE WITH ELECTROMAGNETIC NEEDLE SELECTION

BACKGROUND OF THE INVENTION

1. Field of the Invention

This invention relates generally to knitting machines and, more particularly, to knitting machines that can electromagnetically select the needles in the machine.

2. Description of the Prior Art

There are presently known knitting machines of the type in which sliding selection devices can occupy two different positions, that is, can be either in the active position or the inactive position. U.S. Pat. No. 4,481,793 describes such a knitting machine in which each needle may be selected electromagnetically according to the so-called "three-track" technique, in order to execute different designs or shapes. In that three-track system, the needles may be controlled individually to place them into a working position, a tucking position, or an out-of-action position. To accomplish this, the sliding devices are each movable into two different positions by electromagnetic selection stations and are juxtaposed in pairs, one pair per needle, by means of a so-called two-arm lever.

There is also known from Swiss Pat. No. 641,852 a knitting machine in which the sliding devices are arranged to cooperate with each needle by a two-arm lever, but in that case the two-arm levers may occupy three different positions.

In both of these cases, the two-arm levers are arranged in such a way as to occupy three different positions corresponding to the desired three different needle positions.

One drawback in this known "3-track" solution is that it does not allow for the addition of any supplementary "track".

Swiss Pat. No. 448,358 describes a mechanical device applied to rectilinear knitting machines that have stitch cams with two working faces in tiers, or arranged in a staggered fashion, in which the needle butts of the jacks activate the needles which may be placed in contact, at will, by a known selector mechanism. The needle butts that are engaged with one of the two tier faces are used to make regular or standard stitches, and the butts engaged with the other face are used to make lengthened stitches.

OBJECT AND SUMMARY OF THE INVENTION

Accordingly, it is an object of the present invention to provide an electromechanical needle selection apparatus that can eliminate the above-noted drawbacks inherent in the prior art.

In effect, the purpose of this invention is to supply a supplementary possible selection by appropriate devices to have, for instance, a machine permitting knitting of lengthened stitches as desired so that the supplemented length thus obtained may make it possible to transfer stitches from one needle bed to another, particularly at the edges and at cables.

The arrangement of a supplementary selection possibility, according to the invention, may also be used to obtain a machine which permits incorporation within the known "3-track" positions of a supplementary position in the form of a "stitch transfer" position.

In accordance with an aspect of the present invention, a knitting machine is provided with electromagnetic selection of needles and with a stitch transfer capability, the machine being of the kind including needle beds arranged in pairs having grooves in which are located the needles and the needle selectors. The needles are capable of being positioned either at the level of the needle bed or above it and the selectors are provided with needle butts that can be positioned at different levels in relation to the needle bed, as well as in different positions along the grooves. Electromagnetic selector stations are provided to operate sliding devices to occupy two different positions, with a pair of sliding devices provided for each needle. Fixed vertical cams are formed on the knitting carriage and cooperate with specifically arranged two-arm levers that accomplish the needle selection. The two-arm levers are so constructed and arranged such that they can be oriented in four different positions by action of the sliding devices, which include two lower selectors. These two lower selector elements are activated in such a way as to produce the four positions of the two-arm levers.

The above and other objects, features, and advantages of the present invention will become apparent from the following detailed description of illustrative embodiments thereof to be read in conjunction with the accompanying drawings, in which like reference numerals represent the same or similar elements.

DESCRIPTION OF THE PREFERRED EMBODIMENTS

Figure 1:
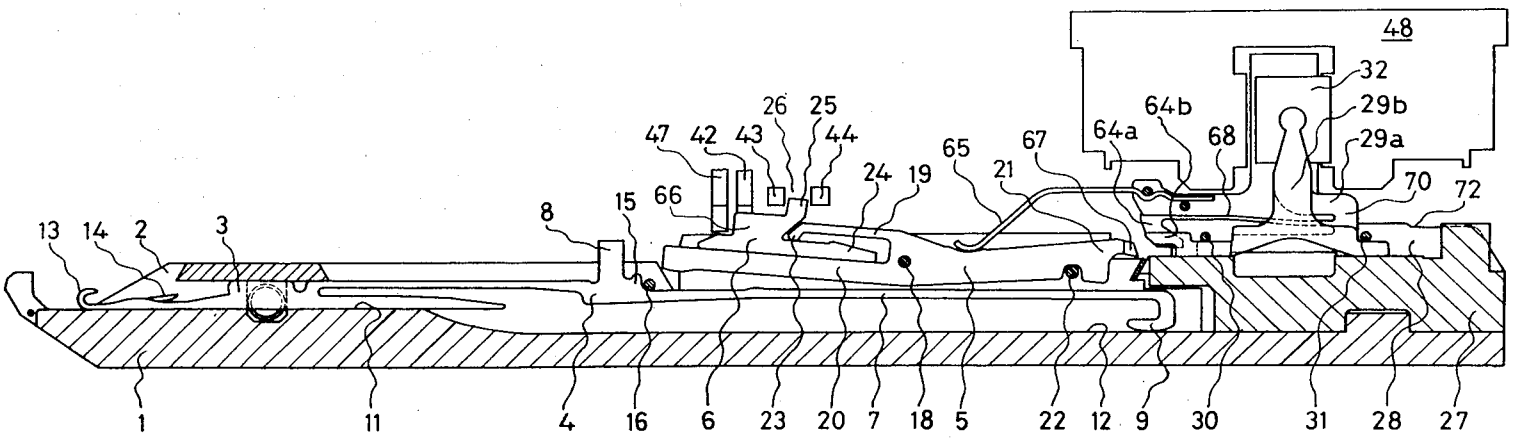
FIG. 1 is an elevation in partial cross section of a needle bed, illustrating a "tuck" selection.

The needle bed 1 of FIG. 1 is of the kind found in a rectilinear knitting machine, which generally has two needle beds arranged in pairs in an inverted V shape, and which has several parallel grooves 2. In each groove 2 is arranged a needle 3 connected to a jack 4, a two-arm lever 5, and a tuck selector 6. Jack 4 is composed of a flexible arm 7, which has a butt 8 generally at the middle of jack 4 and a sliding foot 9 at the distal end of needle 3. Groove 2 is deepened toward the back of the needle bed, which is toward the right in FIG. 1, and thereby forms two slide faces 11 and 12 on which needle 3 and gliding foot 9 slide, respectively. Needle 3 includes a needle hook 13 with a latch 14 in the known manner, and jack 4 has a retaining lug 15. The needle can be placed permanently in the out-of-action position manually by driving needle butt 8 of jack 4 in groove 2 so that a retaining lug 15 located behind butt 8 passes under a wire 16, which keeps jack 4 in this position and the needle inactive as long as no manual displacement is made.

The two-arm lever 5 pivots on pin 18, which is rigidly connected to needle bed 1, and has an upper arm 19 and a lower arm 20, which together form a fork in which tuck selector 6 is guided. Lower arm 20 makes contact with flexible arm 7 of jack 4 between retaining lug 15 and gliding foot 9 of jack 4. Two-arm lever 5 also is provided with a feeler 21, diametrically opposite the fork with respect to pivoting pin 18. A limiting wire 22, which is rigidly attached to needle bed 1, limits a farthest rotary position of said two-arm lever 5 in the clockwise direction. Tuck selector 6 can slide lengthwise over a distance limited by lug 23 acting on nose 24 of tuck selector 6, that is, it abuts the flank of butt 25 of tuck selector 6. This butt 25 may or may not work with cam track 26, as will be described in detail below.

An auxiliary needle bed 27 is mounted on needle bed 1, in the rearmost extensions of grooves 2, and it has several grooves 28 that are double in number to the number of grooves 2 of needle bed 1. In grooves 28 are arranged slide devices in the form of a first lower selector **29*a* and a second lower selector 29*b*, alternating in juxtaposition and retained vertically by wires 30 and 31, which are rigidly attached with auxiliary needle bed 27. An upper selector 32 is also part of the sliding devices is arranged on each lower selector 29*a* or 29*b***, respectively.

Figure 2:
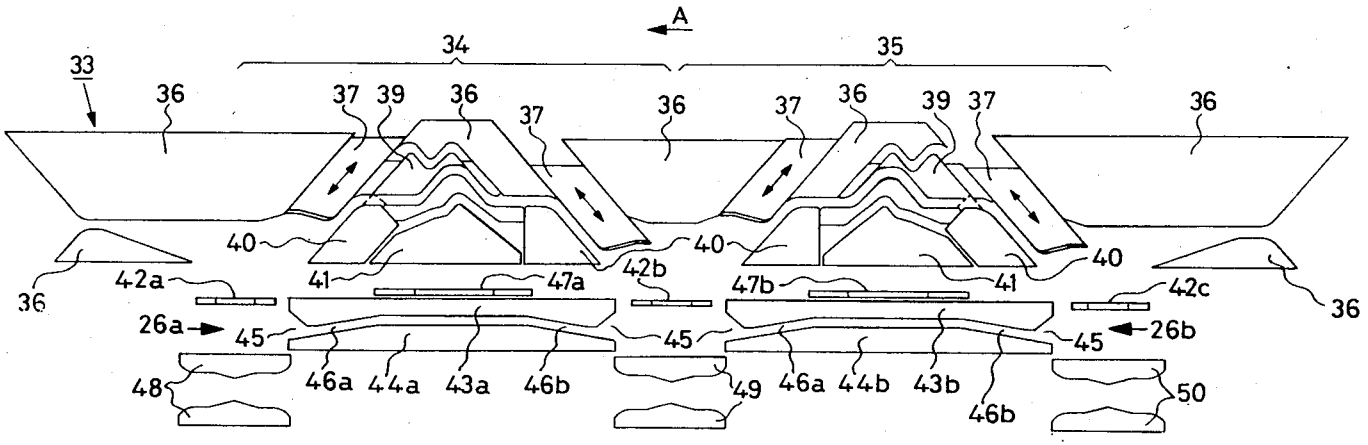
FIG. 2 is a schematic representation of a knitting cam box with two knitting systems, including vertical cams, stitch cams in tiers, and selection stations in conjunction with a knitting carriage.

For each needle bed there is a cam box 33, as shown in FIG. 2, composed of a first knitting system 34 and a second knitting system 35. Each cam box 33 has fixed cams 36, 39, and 41, and stitch cams 37 that are movable in a plane parallel to the cam box. Stitch cams 37 are arranged in tiers permitting the needle butts to traverse in regular or special operation. Lifting cams 40 are provided and are movable only in a plane perpendicular to the cam box. Lifting cams 40 may be placed into a remote or closer position with respect to their needle bed, at the operator's option, and these positions are changed only for the operation of transferring stitches. Fixed vertical cams 42, as shown FIG. 1, are provided for each knitting system, and these comprise fixed cams **42*a* and 42*b* for knitting system 34 and cams 42*b* and 42*c* for knitting system 35 of FIG. 2. It will be appreciated that fixed vertical cam 42*b*** works with both knitting systems.

In FIG. 2, a cam track **26*a*, 26*b* is shown provided for each knitting system, and these tracks are formed by upper cams 43*a* and 43*b* and lower cams 44*a* and 44*b*, respectively. Each cam track 26*a* and 26*b* has, respectively, at its inlet and at its outlet funnel-shaped entries 45, an ascending portion 46*a* and a descending portion 46*b***, in the direction of movement of the cam boxes.

Furthermore, a fixed vertical cam 47, as shown, is provided for each knitting system and comprises a vertical cam **47*a* pertaining to knitting system 34 and a vertical cam 47*b* pertaining to knitting system 35, as shown in FIG. 2. Each knitting system is directly preceded, as seen from the direction of movement of the cam boxes, by a selector station, as shown in FIG. 2. When the cam boxes are displaced in the direction indicated by arrow A, selector station 48 precedes knitting system 34 and selector station 49 precedes knitting system 35. During movement in reverse, selector station 50 precedes knitting system 35 and selector station 49 precedes knitting system 34. Thus, selector station 49 is provided to work with both knitting systems 34 or 35**, depending on the direction of movement of the cam boxes.

Figure 3:
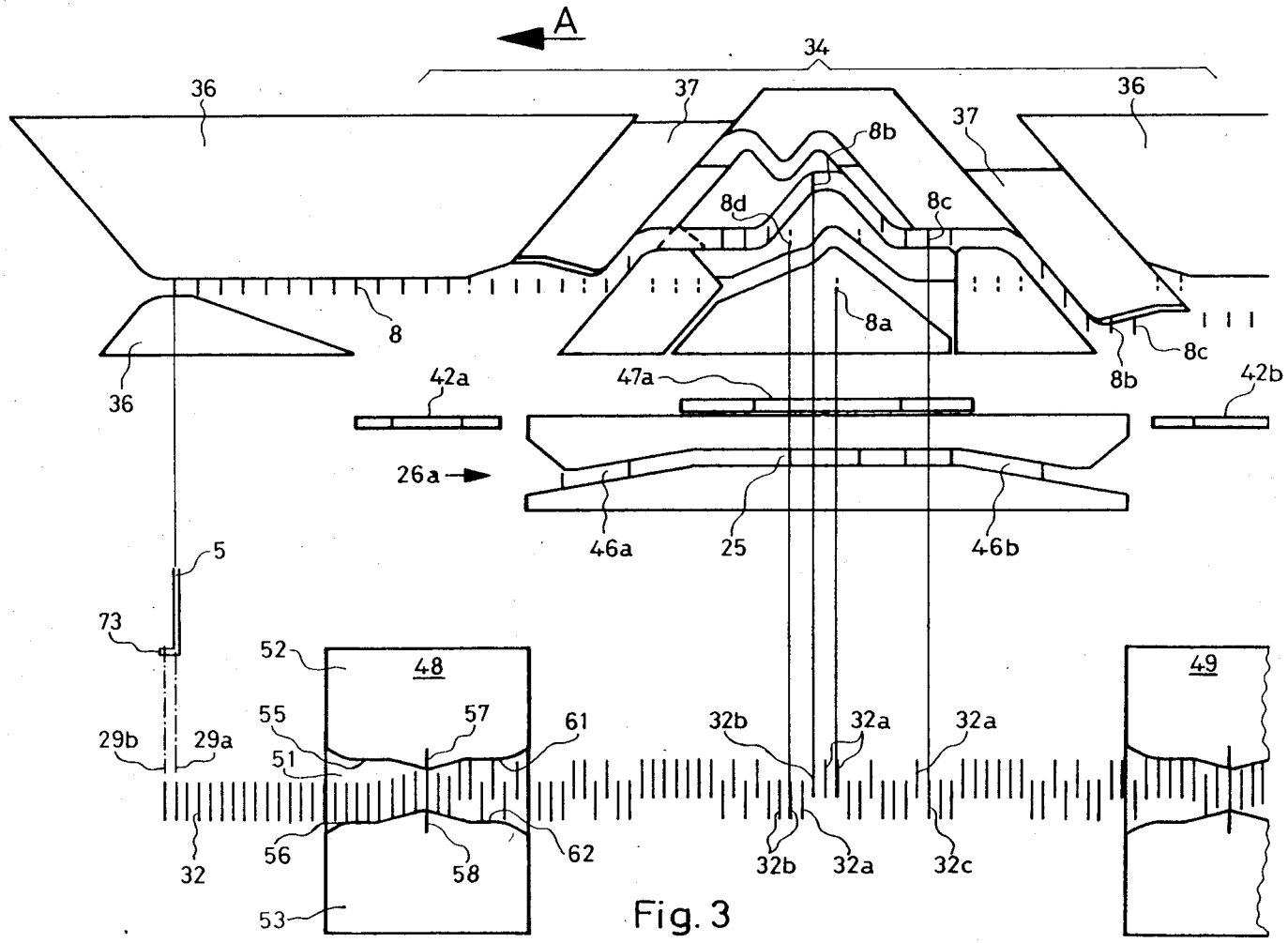
FIG. 3 is a portion of FIG. 2 on a larger scale, illustrating different needle selections.

Each selector station 48, 49, and 50, as shown in FIG. 3, has a base plate 51 on which are mounted two identical selection half-stations 52 and 53 to form the selector channel in which the upper selectors 32 of FIG. 1 move. This arrangement is intended to accommodate travel in either direction. In this example, the upper selectors 32 move with respect to the knitting system in the direction shown by arrow A. The selector channel has an entry which narrows down and is bordered by flanks 55 and 56 and by a selection point that is defined as the narrowest point of the channel between poles 57 and 58 of the selector electromagnets (not shown). The selector channel also has an outlet which widens and is bordered by the selector point and by flanks 61 and 62.

To select any needle freely without restriction, either in the out-of-action position, the tuck position, the regular stitch in-action position, or in the lengthened stitch in-action position, the operator makes his selection of the two different positions available for upper selectors 32, two of which are provided for each needle 3. The two different positions are attained if either one of the selector electromagnets is excited and the upper selector 32 is at the narrowest portion of the channel against its pole 57 or 58. Then, the selector follows side 61 or 62 and is drawn by magnetic attraction outside the longitudinal symmetric plane of the selector station.

Figure 4:
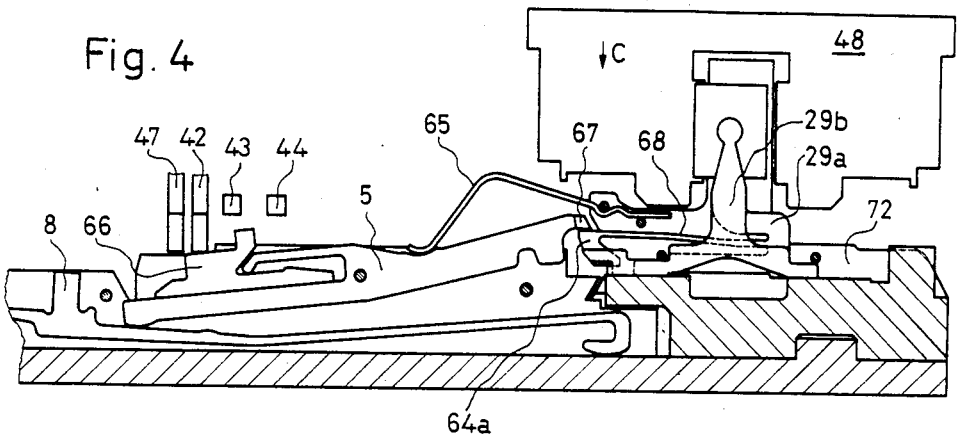
FIG. 4 is an elevation in partial cross section similar to FIG. 1, illustrating an "off" selection.
Figure 6:
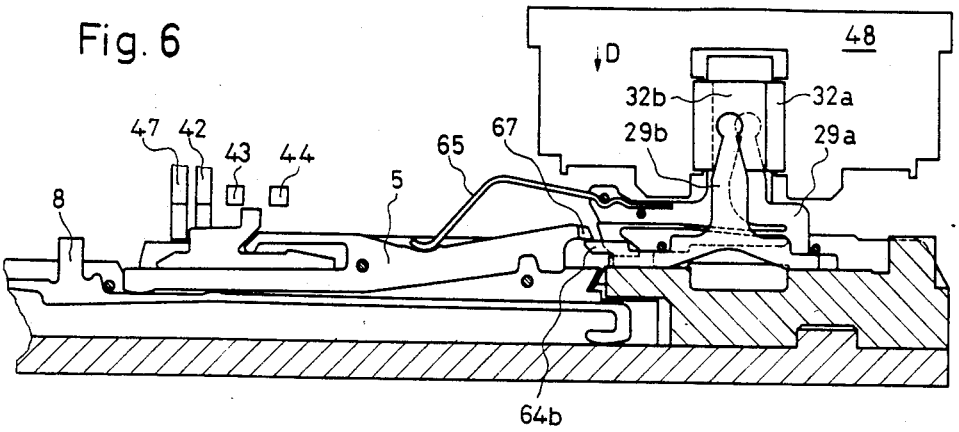
FIG. 6 is an elevation in partial cross section similar to FIG. 1, illustrating a selection for "knitting lengthened stitches"
Figure 8:
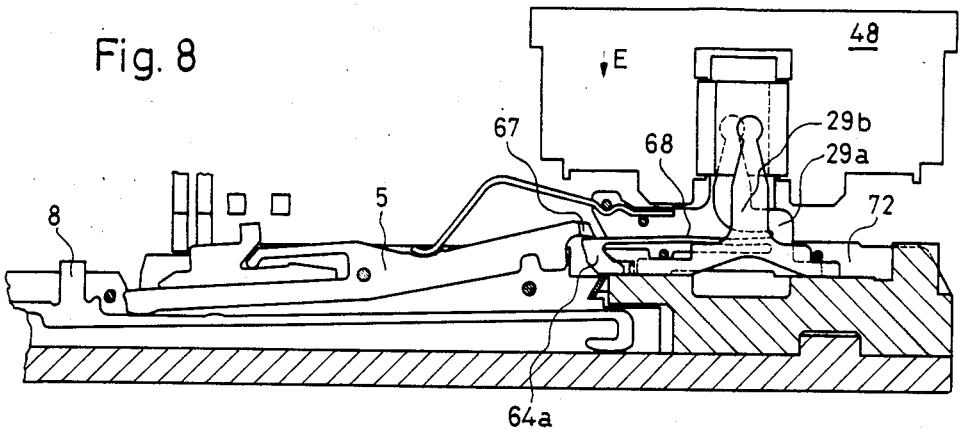
FIG. 8 is an elevation in partial cross section similar to FIG. 1, illustrating a selection for "normal stitch knitting;"

Upper selector 32 is mounted on lower selector **29*a* or 29*b* (FIGS. 4, 6, and 8). The latter must therefore follow the movements of the former and, thus, occupies one of the two different positions described above. The left or inner end of the lower selector 29*a* has a contact face 64*a* located at an upper level relative the bottom of groove 28, connected by a flexible arm 68 to central portion 70, as seen in FIGS. 1, 4, 6, and 8**.

Figure 5:
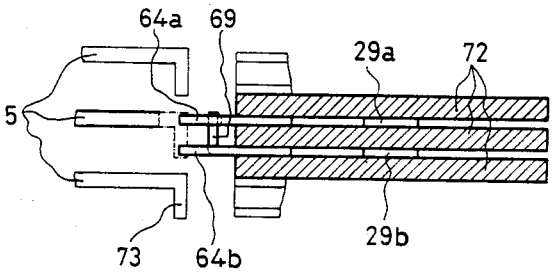
FIG. 5 is a plan view along arrow C in FIG. 4.
Figure 7:
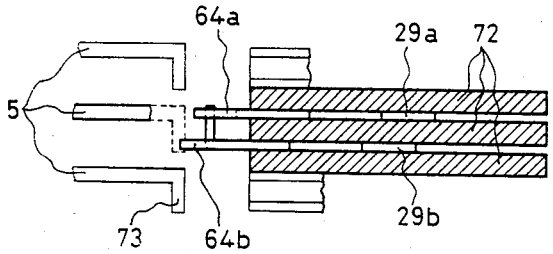
FIG. 7 is a plan view along arrow D in FIG. 6.
Figure 9:
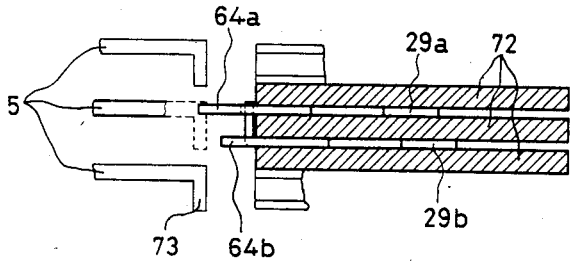
FIG. 9 is a plan view along arrow E in FIG. 8.

Lower selector **29*b* is juxtaposed to lower selector 29*a* and separated by a non-magnetic track wall 72, as shown in FIGS. 5, 7, and 9. Its left or inner end has a contact face 64*b* located at a lower level relative to the bottom of groove 28. Also, a broadened end 69 is added to the same end of lower selector 29*b*, in the direction of the lower selector 29*a*, and enables the operator to adjust the level of contact face 64*a* of lower selector 29*a*, as shown in FIG. 5**.

The two lower selectors **29*a* and 29*b* each act on the same two-arm lever 5 through a broadened end 73 of a notch 67 formed in the end of two-arm lever 5 opposite arms 19 and 20. This broadened end 73 is shown in FIGS. 5, 7, and 9 is located opposite the left ends of lower selectors 29*a* and 29*b***.

In order to aid understanding of the present invention, the principle of needle selection in "four tracks" will be described with reference to the drawings. Considering FIGS. 1 and 3, assume that the cam boxes are moved in the direction of arrow A, and that selectors 32 are in a "working" position being so placed by selector station 48 during the previous passage of the cam boxes in the opposite direction. Fixed vertical cam **42*a* presses on all the lower butts 66 of the tuck selectors 6, against a spring effect of spring 65 and of the flexible arm 7 of jack 4. For this reason, every two-arm lever 5 revolves around its axis 18 and notch 67 of the two-arm lever 5 is above the left end of lower selector 29*a* or 29*b***.

Selector station 48 displaces upper selectors 32 in the two different positions, and once the selection has been made, fixed vertical cam 42*a* is bypassed under the action of spring 65 and flexible arm 7 of jack 4, and the two-arm levers 5 tend to revert to their positions according to FIG. 1.

Lower selectors 29*a* and 29*b*, the upper selectors 32 of which are selected at 32*a*, have their left ends advanced so that notches 67 abut contact faces 64*a* of lower selectors 29*a* which in turn come into contact with the broadened end 69 of the lower selectors 29*b*, thus preventing two-arm levers 5 from returning, as represented in FIG. 4. Needle butts 66 of the corresponding pins will remain pushed inside needle bed 1 and thus be in position 8*a* of FIG. 3. The corresponding needles 3 will be out of action.

Lower selectors 29*a*, for which the upper selectors 32 are selected at 32*a*, will have their left ends pushed back and lower selectors 29*b*, for which the upper selectors 32 are selected at 32*b*, will have their left ends advanced, so that notches 67 abut contact faces 64*b*, as shown in FIG. 6. Their two-arm levers 5 thus return to a medium position where they do not press any more on flexible arms 7 of jack 4, so that the corresponding needle butts 8 completely come out of needle bed 1 and will be engaged by the cams of the knitting system 34, but above all by the stitch cams that are arranged in tiers. See position 8*c* of FIG. 3. Thus, the corresponding needles 3 will form lengthened stitches.

Lower selectors 29*a*, the upper selectors 32 of which are selected at 32*b*, will have their left ends advanced, and lower selectors 29*b*, the upper selectors 32 of which are selected at 32*a*, will have their left ends pushed back, so that notches 67 will abut contact faces 64*a*, as shown in FIGS. 8 and 9, in a lowered position because of the flexible arm 68 of the lower selectors 29*a*. Thus, two-arm levers 5 will return to a second medium position where they press again partially on flexible arms 7 of jacks 4, so that the respective needle butts 8 partially come out of needle bed 1 and will be engaged by the cams of knitting system 34. See position 8*b* of FIG. 3. Thus, the corresponding needles 3 will form regular or standard stitches.

Lower selectors 29*a* and 29*b*, the upper selectors of which are selected at 32*b*, will have their left ends pushed back so that they are beyond the reach of notches 67, as shown in FIG. 1. Thus, their two-arm levers 5 will return to the position shown in FIG. 1, under the pressure of spring 65. These two-arm levers 5 no longer press on their jacks 4 which are therefore engaged by the cams of the knitting system. Butts 25 of the corresponding tuck selectors 6 follow the path of cams 26*a*, shown in FIG. 3, and they ascend into the ascending portion 46*a*, so that their lower butts 66 are pushed into the operational area of fixed vertical cam 47*a* and according to the same principle as vertical cam 42*a*, it presses on lower butts 66 of the respective tuck selector 6. Needle butt 8 of the corresponding jack 4 is momentarily pushed down and assumes position 8*d* of FIG. 3. Once released by vertical cam 47*a*, the descending portion 46*b* replaces tuck selector 6 into its position shown in FIG. 1 and needle butt 8 of jack 4 returns into the operational area of the cams and is pushed down by stitch cam 37. The needles so selected will tuck the yarn. The same process takes place for the second knitting system, in this case knitting system 35, by means of fixed vertical cam 42*b* of selector station 49 and of vertical fixed cam 47*b*.

Figure 10:
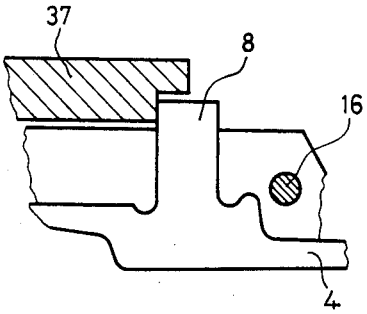
FIG. 10 is a simplified view of a needle butt engaged with a recessed tier of a stitch cam for "knitting normal stitches;"

FIG. 10 represents the relationship between butt 8 on needle jack 4 and a stitch cam 37. More specifically, butt 8 is engaged with the recessed tier of stitch cam 37 and this position corresponds to the operation for "knitting normal stitches."

Figure 11:
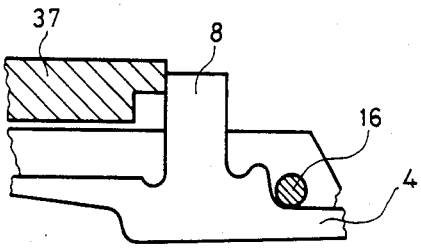
FIG. 11 is a simplified view corresponding to FIG. 10, wherein the needle butt is engaged with the forward tier of the stitch cam for "lengthened stitch knitting."

Similarly, FIG. 11 represents a different engagement between butt 8 and stitch cam 37 in which the needle butt 8 is engaged with the forward tier of the stitch cam. In this position the "lengthened stitch knitting" operation is provided.

By a judicious combination of the individual position of the paired selectors acting on the same needle, four different positions are obtained for each two-arm lever and, thus, four selected positions of the needle for a single passage of the knitting system. In principle, it is unimportant of the idea of the invention that instead of and in place of the individual selection of needles making lengthened stitches, it is possible also to choose another application of individual selection thus created, for instance by combining in one cam box and one run of the needles the four positions: knitting, tucking, out-of action, and transfer of stitches, without any restriction.

The above description is given on the preferred embodiments of the invention, but it will be apparent that many modifications and variations could be effected by one skilled in the art without departing from the spirit or scope of the novel concepts of the invention, so that the scope of the invention should be determined by the appended claims only.

What is claimed is:

1. In a knitting machine with electromagnetic selection of needles of the kind with stitch transfer capability and including needle beds arranged in pairs equipped with grooves in which are located needles and selectors with needle butts, which needles can be positioned at the level of or above the needle bed, and with the selector needle butts capable of being positioned at different levels in relation to the needle bed and in different positions along the grooves, and having electromagnetic selection stations cooperating with sliding elements to enable them to occupy two different positions; one pair of sliding elements being supplied for each needle, and having vertical cams fixed and placed on a knitting carriage of the knitting machine acting on two-arm levers and releasing the respective two-arm levers after the needle selection, with the two-armed levers being retained or released by the sliding elements, the improvement characterized by means for orienting said two-arm levers in four different positions, and by lower selector means forming the sliding elements and being adapted for movement into two different positions for cooperating with an end of a corresponding two-arm lever, whereby said lower selector means are actuated in such a way as to produce said four positions of said two-arm levers.

2. A knitting machine according to claim 1, characterized by the fact that said lower selector means comprises two juxtaposed lower selectors, a first lower selector and a second lower selector, which in combination obtain the four positions of the two-arm lever.

3. A knitting machine according to claim 2, characterized by the fact that each said first lower selector has a contact face that cooperates with said two-arm lever to arrive at one of the four positions of said two-arm lever.

4. A knitting machine according to claim 2, characterized by the fact that each said first lower selector has a broadened end on a face which is facing said second lower selector.

5. A knitting machine according to claim 2, characterized by the fact that each second lower selector has a supporting surface that cooperates with said two-arm lever to achieve one of the four positions of said two-arm lever.

6. A knitting machine according to claim 2, characterized by the fact that each second lower selector has a flexible arm which at one end cooperates with a broadened end of said first lower selector and with said corresponding two-arm lever.

7. A knitting machine according to claim 1, characterized by the fact that one of the four positions of said two-arm lever gives the needle a position in which a butt of the needle acts on one of a plurality of stitch cams mounted on said knitting carriage and having staggered engaging surfaces.

8. A knitting machine according to claim 1, characterized by the fact that said needle butts may be positioned in three different positions with respect to the needle bed, two of said positions being above said needle bed.

* * * * *